US012630339B2

(12) United States Patent
Han et al.

(10) Patent No.: US 12,630,339 B2
(45) Date of Patent: May 19, 2026

(54) DRINKING CONTAINER

(71) Applicant: HANGZHOU JIMI NETWORK TECHNOLOGY SERVICE CO., LTD, Hangzhou (CN)

(72) Inventors: Xiong Han, Hangzhou (CN); Huabing Zeng, Hangzhou (CN)

(73) Assignee: HANGZHOU JIMI NETWORK TECHNOLOGY SERVICE CO., LTD, Hangzhou (CN)

( * ) Notice: Subject to any disclaimer, the term of this patent is extended or adjusted under 35 U.S.C. 154(b) by 0 days.

(21) Appl. No.: 18/822,707

(22) Filed: Sep. 3, 2024

(65) Prior Publication Data

US 2026/0035147 A1 Feb. 5, 2026

(30) Foreign Application Priority Data

Aug. 1, 2024 (CN) ..... 202411048899.4

(51) Int. Cl.
*A47G 19/22* (2006.01)
*B65D 47/08* (2006.01)
*B65D 77/28* (2006.01)

(52) U.S. Cl.
CPC ..... *B65D 47/0857* (2013.01); *B65D 77/28* (2013.01)

(58) Field of Classification Search
CPC ..... B65D 47/0857; B65D 77/28
See application file for complete search history.

(56) References Cited

U.S. PATENT DOCUMENTS

| | | | | |
|---|---|---|---|---|
| 10,246,228 | B2 | 4/2019 | Meyers | |
| 10,524,597 | B2 | 1/2020 | Sorensen | |
| 2019/0183269 | A1* | 6/2019 | Kalisz | A47G 19/2266 |

* cited by examiner

*Primary Examiner* — Andrew D Perreault
(74) *Attorney, Agent, or Firm* — HOWARD M COHN and Associates, LLC

(57) ABSTRACT

A drinking container includes a container, a lid covering the container, and a seal ring disposed between the container and the lid. A drinking spout is disposed on the lid. A first passage and a second passage are disposed on a lower end of the drinking spout. A valve body is disposed in a lower end of the first passage. A lower end of the second passage is connected to a straw. The second passage is always in an open state. In a straw mode, a liquid in the container flows out of the drinking spout through the second passage, and the valve body inside the lid closes the first passage. In a direct drinking mode, the valve body opens the first passage, and the liquid in the container flows out of the drinking spout through the first passage.

9 Claims, 7 Drawing Sheets

DRINKING CONTAINER

TECHNICAL FIELD

The present invention relates to the field of water cup technology, especially involving a drinking container.

BACKGROUND ART

A water cup is a common daily necessity, and a container to hold liquids, usually used to drink tea, water, beverages, etc. The common water cups are made of plastic, glass, porcelain or stainless steel. There are direct drinking cups and sippy cups. In order to meet different user requirements, the double drinking cups used for direct and straw drinking have been invented on the market.

Disclosed content of the existing double drinking cup (U.S. Pat. No. 10,524,597B2): A lid sized and configured to be attached to a container, the container sized and configured to be filled with one or more fluids, the lid comprising: a body including an upper portion and a downwardly extending sidewall; a spout that extends from the upper portion; a first opening disposed within the spout, the first opening providing a first fluid pathway through the lid; and a second opening disposed within the spout, the second opening providing a second fluid pathway through the lid, wherein a majority of the second opening is positioned forward of all of the first opening. The first opening of the above lid is normally open, with the lack of the seal structure. When the user drinks water with the straw, the liquid may overflow from the first opening, to bring the bad drinking experience to the user.

Disclosed content of the existing double drinking cup (U.S. Pat. No. 10,246,228B2): A liquid dispensing container comprising: a body comprising a reservoir configured to hold a liquid; a lid attached to the body; and a valve assembly comprising a conduit, the conduit movable relative to the lid between a closed position, a first open position and a second open position; wherein: when the conduit is in the closed position, the valve assembly inhibits fluid flow through the conduit; when the conduit is in the first open position, a first passageway for the liquid extends from the reservoir through a first opening in the conduit; and when the conduit is in the second open position, a second passageway for the liquid extends from the reservoir through a second opening in the conduit. Although the lid of the above water cup involves two drinking modes, the structure is relatively complicated. It is required to manually switch the drinking mode. The user's operation is more complicated, which is not convenient for production.

SUMMARY OF THE INVENTION

The present invention provides a drinking container to overcome the shortcomings of existing technologies. In order to achieve the above purpose, the present invention adopts the following technical proposal.

A drinking container, composed of a container and a lid covering the container, with a seal ring between the container and the lid, wherein the drinking spout is set on the lid, the lower end of the drinking spout is provided with the first and second passages for liquid flow inside the container, the lower end of the first passage has the valve body, the lower end of the second passage is connected to the straw, the first passage can be opened with the movement, and the second passage is normally open;

In the straw mode, the liquid in the container flows out of the drinking spout through the second passage that is normally open, and the valve body inside the lid closes the first passage;

In the direct drinking mode, the liquid in the container flows out of the drinking spout through the first passage that can be opened with the movement, and the valve body opens the first passage with the movement of the container;

The valve body is composed of a connecting plate, a plug at one end of the connecting plate, and a block at the other end of the connecting plate, closes the first passage through the plug, and moves through the block.

Further, the valve body is axially connected to the lower end of the lid, the shaft blocks are disposed inside the lid, the shaft column are disposed on two sides of the connecting plate, the shaft blocks respectively fit both sides of the connecting plate and is fixed by installing the shaft columns inside the shaft blocks, and the valve body can only move along the drinking spout through the connection structure on both sides.

Further, the sealing fin is set at the upper end of the plug, and the outer contour of the upper end of the sealing fin is more than that of the first passage.

Further, the center of the connecting plate is hollow, and the straw passes through the valve body and is placed at the lower end of the second passage.

Further, the lid is composed of an upper lid and a lower lid, the upper lid is placed on the lower lid, the drinking spout protrudes from the upper lid, the concave mounting slot is set on the lower lid, and the first and second passages are located on the mounting slot.

Further, the sealing block is set inside the mounting slot, the outer contour of the sealing block fits the inner contour of the mounting slot, the inlet slot corresponding to the drinking spout is set on the sealing block, and there is at least one inlet hole for liquid inflow of the first or second passage inside the inlet slot;

In the direct drinking mode, the liquid in the container flows into the inlet slot through the first passage and the inlet hole, and then enters the drinking spout from the inlet slot;

In the straw mode, the liquid in the container flows into the inlet slot through the straw, the second passage, and the inlet hole, and then enters the drinking spout from the inlet slot.

Further, the inlet valve is set on the lid.

Further, the top cap used to close the drinking spout is set above the lid, and the top cap is rotatably connected above the lid; inside the top cap, there is the first sealing plug fitting the drinking spout, and the second sealing plug fitting the inlet valve, and the first and second sealing plugs respectively close the drinking spout and the inlet valve when the top cap is closed.

Further, the locking block is set on the sidewall of the lid.

Compared with existing technologies, the advantages of the present invention are as follows:

The present invention provides the straw mode and direct drinking mode: In the straw mode, the valve body inside the lid closes the first passage, and the liquid in the container cannot enter the first passage; the liquid in the container can only enter the second passage through the straw, and flow out of the drinking spout; the first passage is blocked by the designed valve body, to avoid that, due to shaking caused by drinking with the straw, the liquid in the container overflows from the first passage to bring the bad drinking experience to the users.

In the direct drinking mode, when the user holds and tilts the container, the valve body inside the lid moves and is detached from the first passage; the liquid in the container enters the drinking spout through the first passage; after the user drinks water, the container is placed on the table, the valve body moves and blocks the lower end of the first passage to achieve the closure; the structure is relatively simple, the operation is convenient, and there is no need to manually switch the drinking mode. The user can select the direct drinking or straw mode, with good drinking experience. The simple structure is convenient for production.

Figure 1:
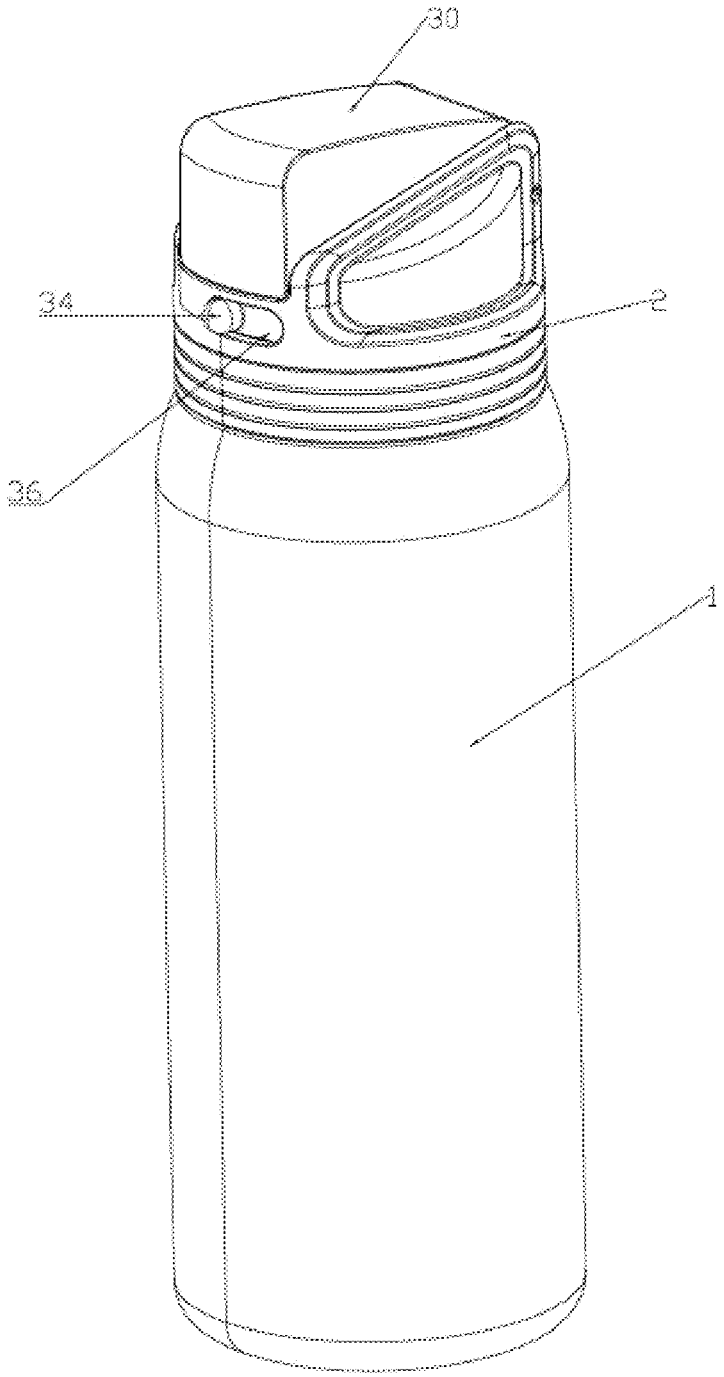
FIG. 1 is the perspective view of the present invention.
Figure 2:
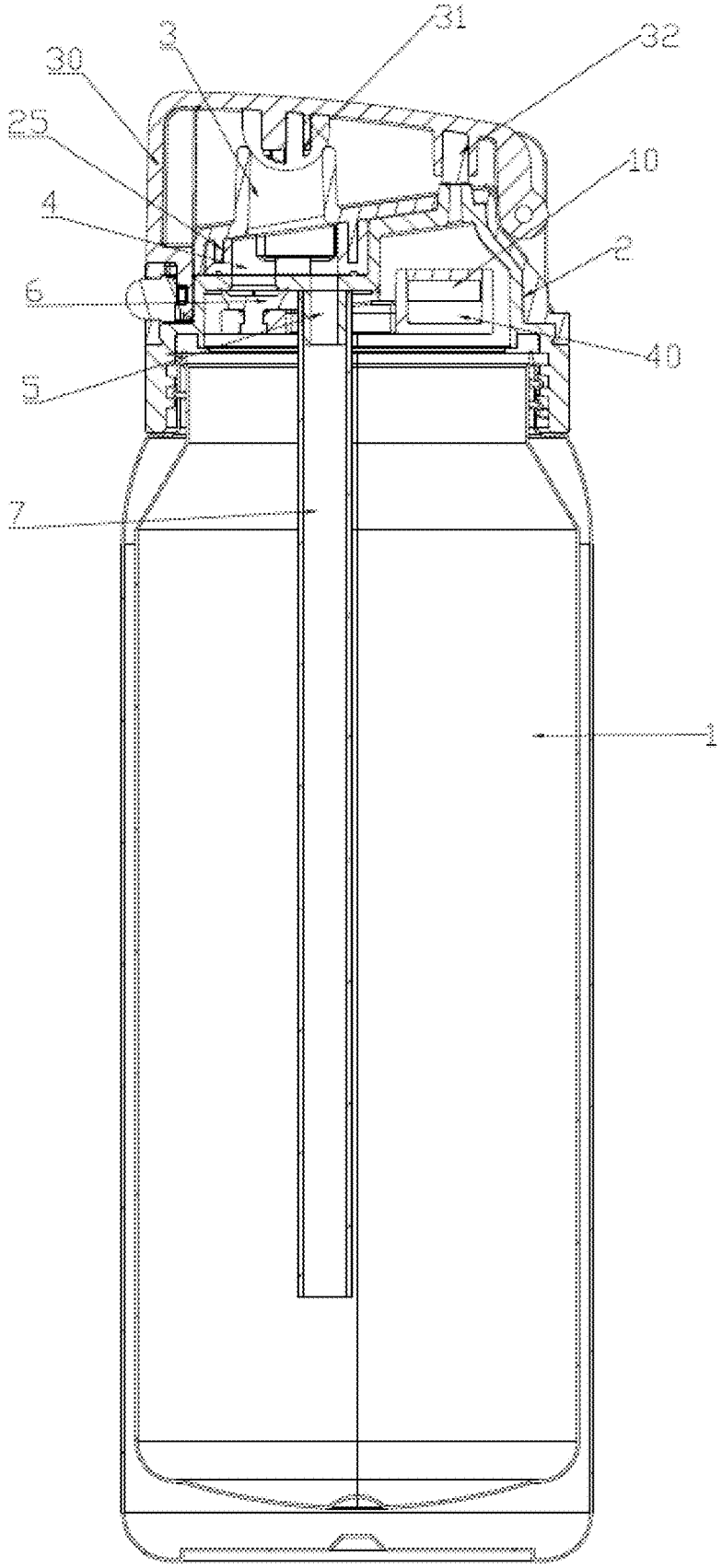
FIG. 2 is the section view of the present invention.
Figure 3:
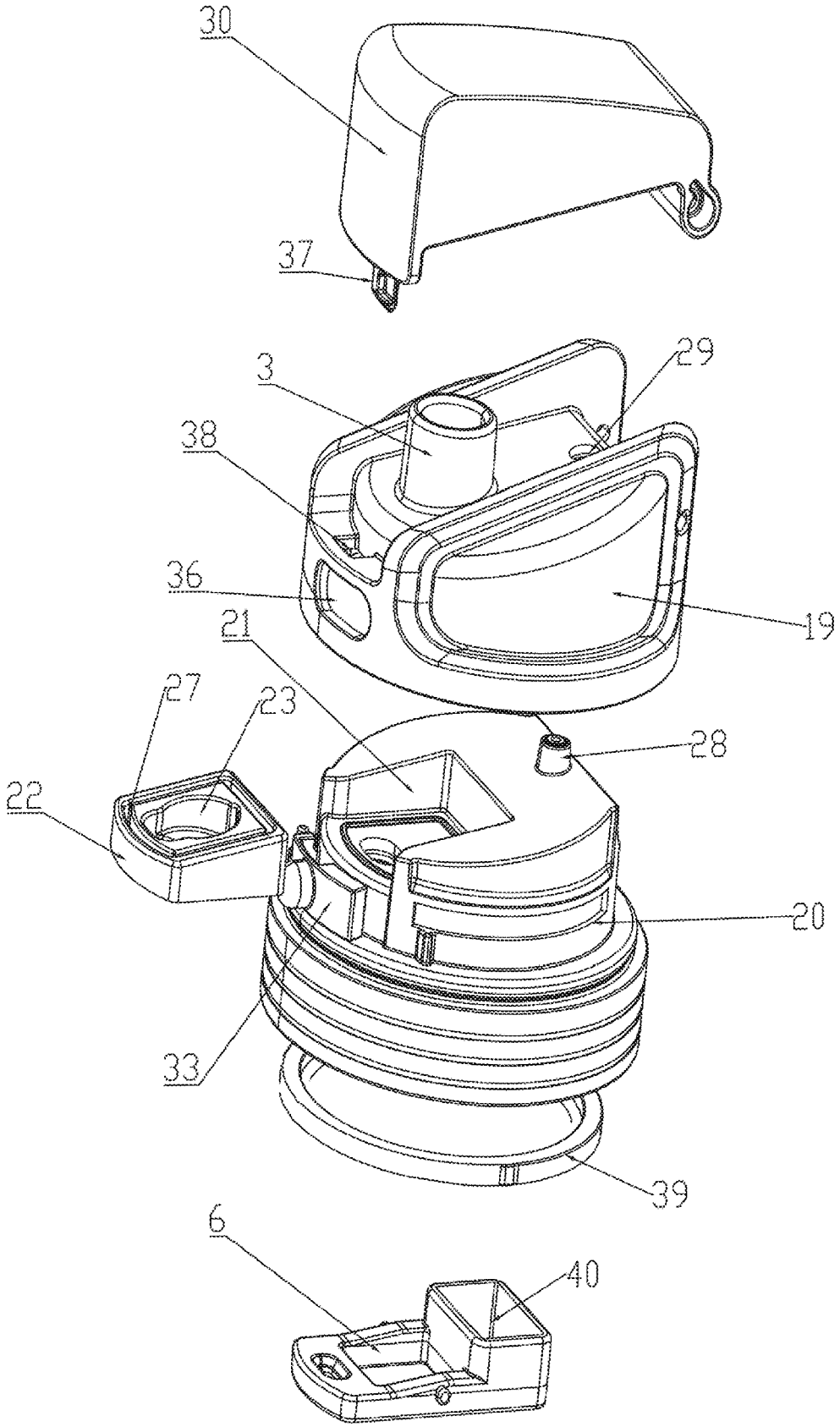
FIG. 3 is the exploded view of the present invention.
Figure 4:
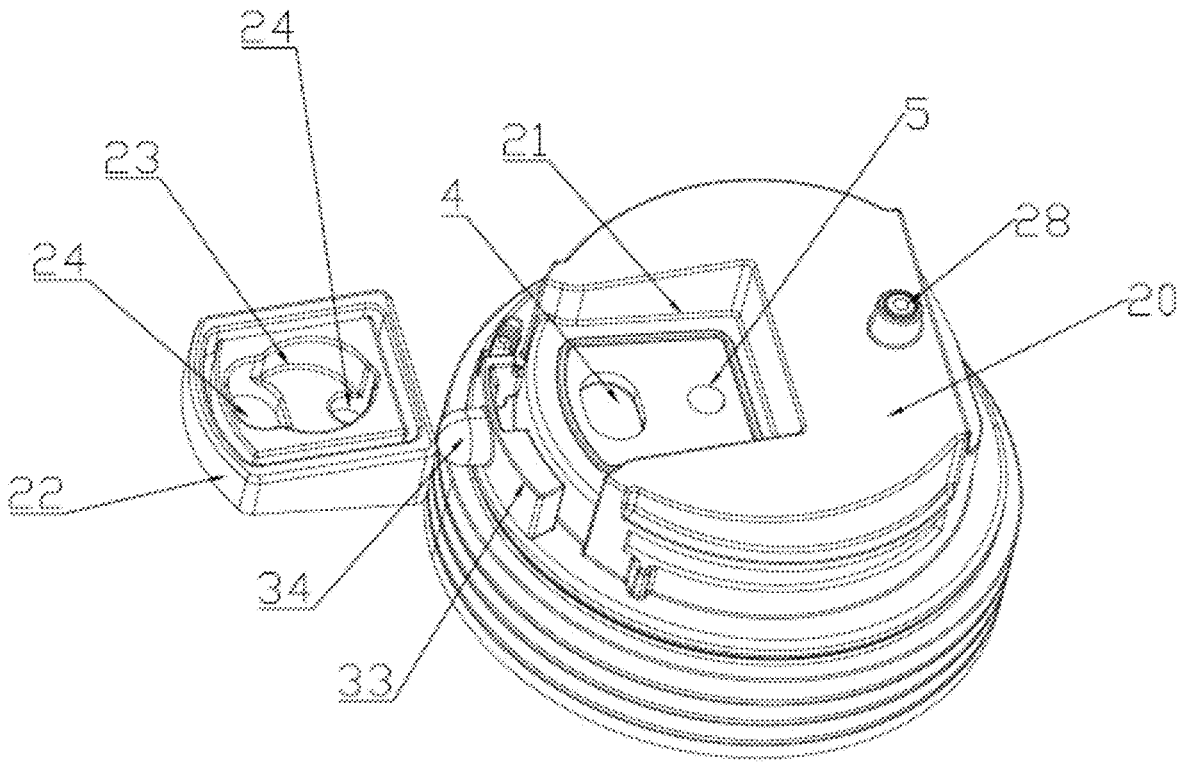
FIG. 4 is the perspective view 1 of the lower lid involved in the present invention.
Figure 5:
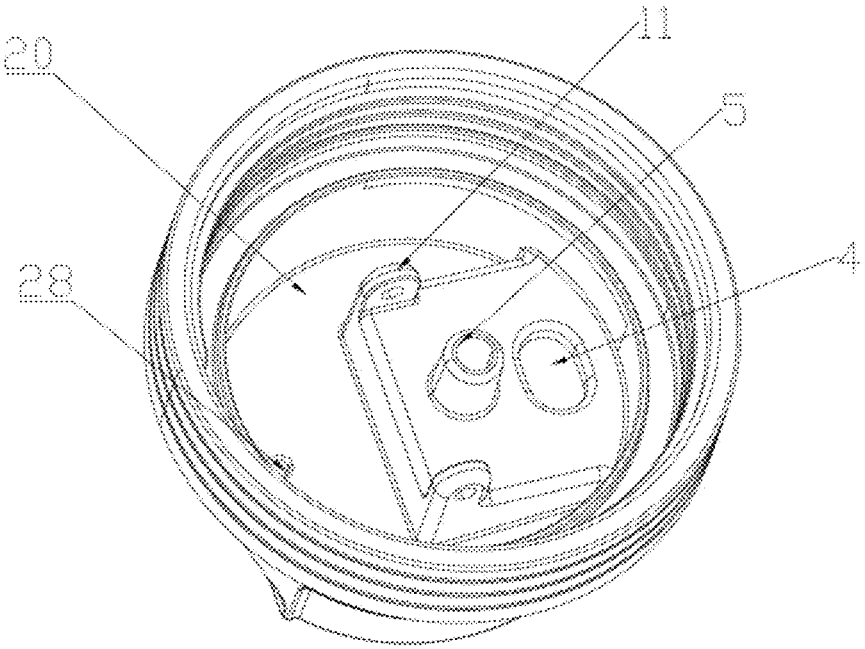
FIG. 5 is the perspective view 2 of the lower lid involved in the present invention.
Figure 6:
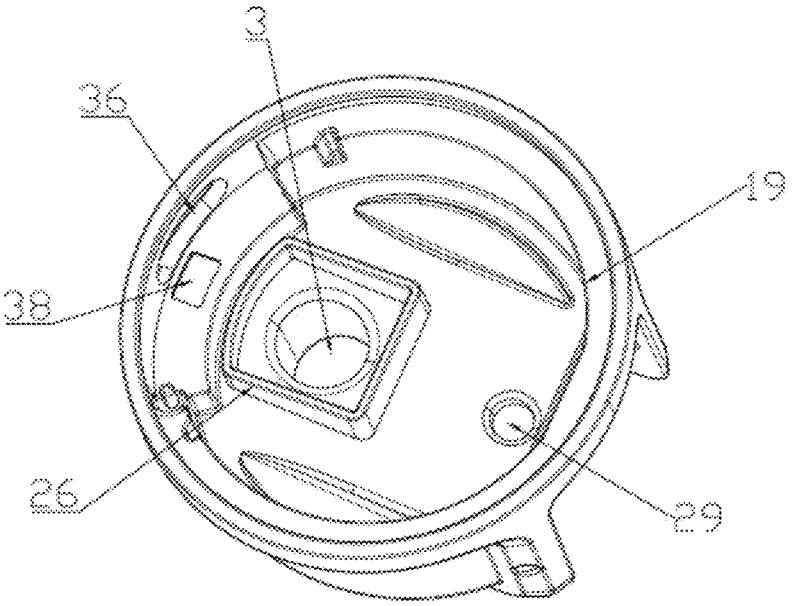
FIG. 6 is the perspective view of the upper lid involved in the present invention.
Figure 7:
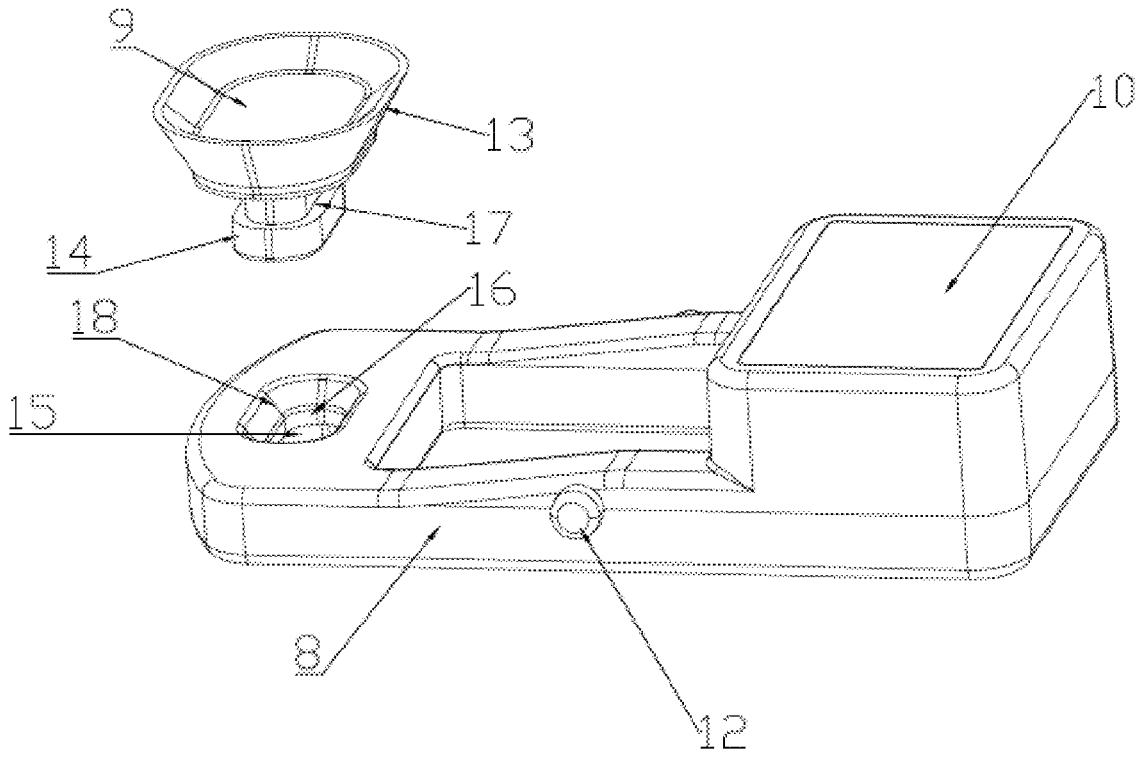
FIG. 7 is the exploded view of the valve body involved in the present invention.
Figure 8:
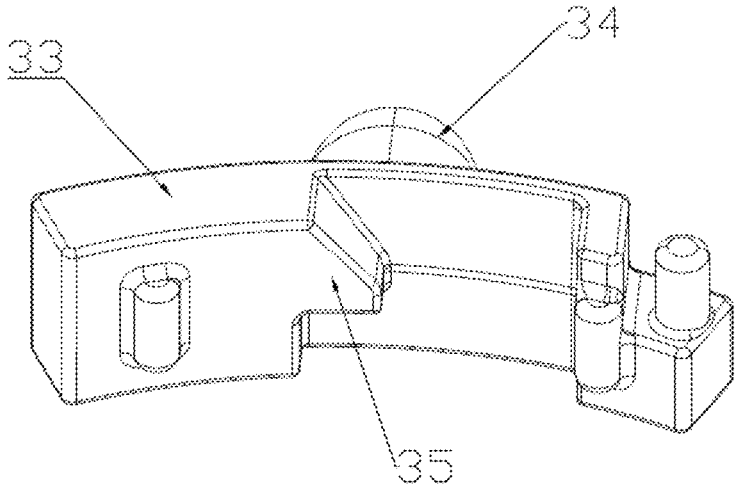
FIG. 8 is the perspective view of the locking block involved in the present invention.

Marks in drawings: 1. Container, 2. Lid, 3. Drinking Spout, 4. First Passage, 5. Second Passage, 6. Valve Body, 7. Straw, 8. Connecting Plate, 9. Plug, 10. Block, 11. Shaft Block, 12. Shaft Column, 13. Sealing Fin, 14. Clamp Block, 15. Clamping Slot, 16. Stop Rib, 17. Limiting Slot, 18. Guide Surface, 19. Upper Lid, 20. Lower Lid, 21. Mounting Slot, 22. Sealing Block, 23. Inlet Slot, 24. Inlet Hole, 25. Sealing Element, 26. Seal Ring, 27. Sealing Slot, 28. Inlet Valve, 29. Hole, 30. Top Cap, 31. First Sealing Plug, 32. Second Sealing Plug, 33. Locking Block, 34. Sliding Block, 35. Locking Piece, 36. Sliding Slot, 37. Latch, 38. Opening, 39. Seal Ring, 40. Cavity.

In combination with the drawings in the embodiments of the present invention, the technical proposal in the embodiments of the present invention is clearly and fully described below. Obviously, the described embodiments are only part of the embodiments of the present invention, not all of them. Based on the embodiments of the present invention, all other embodiments obtained by general technicians without creative labor shall fall within the protection scope of the present invention.

As shown in FIG. 1-9, a drinking container is composed of the container 1 and the lid 2 covering the container 1. The threaded connection is achieved between the lid 2 and the container 1. The drinking spout 3 is set on the lid 2. The lower end of the drinking spout 3 is provided with the first passage 4 and the second passage 5 for liquid flow inside the container 1. The lower end of the first passage 4 has the valve body 6. The space for movement of the valve body 6 is reserved inside the lid 2. The lower end of the second passage 5 is connected to the straw 7. The first passage 4 can be opened with the movement, while the second passage 5 is normally open. The present invention provides the straw mode and direct drinking mode (drinking spout 3): In the straw mode, the valve body 6 inside the lid 2 closes the first passage 4, and the liquid in the container 1 cannot enter the first passage 4; the liquid in the container can only enter the second passage 5 through the straw 7, and flow out of the drinking spout 3; the first passage 4 is blocked by the designed valve body 6, to avoid that, due to shaking caused by drinking with the straw 7, the liquid in the container 1 overflows from the first passage 4 to bring the bad drinking experience to the users. In the direct drinking mode, when the user holds the container 1 with the hand and tilts it towards the drinking spout 3, the valve body 6 inside the lid 2 moves with the movement of the container 1, and is detached from the first passage 4; the liquid in the container 1 enters the drinking spout 3 through the first passage 4; after the user drinks water, the container 1 is placed on the table, and the tilted container 1 is restored; the valve body 6 moves with the movement of the container 1 and blocks the first passage 4 to achieve the closure; the structure is relatively simple, the operation is convenient, and there is no need to manually switch the drinking mode. The user can select the direct drinking or straw mode, with good drinking experience. The simple structure is convenient for production.

The valve body 6 is composed of the connecting plate 8, the plug 9 at one end of the connecting plate 8, and the block 10 at the other end of the connecting plate 8. The connecting plate 8 is rotatably connected to the lid 2, the lower end of the first passage 4 is blocked by the plug 9 to achieve the closure, and the weight of the block 10 is used to achieve the movement of the valve body 6. The connecting plate 8 is located at one end of the block 10, with the cavity 40. The block 10 is installed in the cavity, situated at the upper end of the cavity 40. The block 10 includes the metal block, and its weight is more than that of the plug 9. According to the lever principle, the weight of the block 10 is more than that of the plug 9. One end of the block 10 on the connecting plate is pressed down, so that the plug 9 moves upward to block the first passage 4.

The valve body 6 is axially connected to the lower end of the lid 2 to achieve rotation. Inside the lid 2, there are shaft blocks 11 that extend downward. The shaft columns 12 are disposed on two sides of the connecting plate 8. The shaft blocks 11 respectively fit two sides of the connecting plate, fixed by installing the shaft columns 12 in the holes of the shaft blocks 12. Through the shaft connection structure on both sides, the valve body 6 can only rotate along the drinking spout 3, and cannot move to either side.

Figure 9:
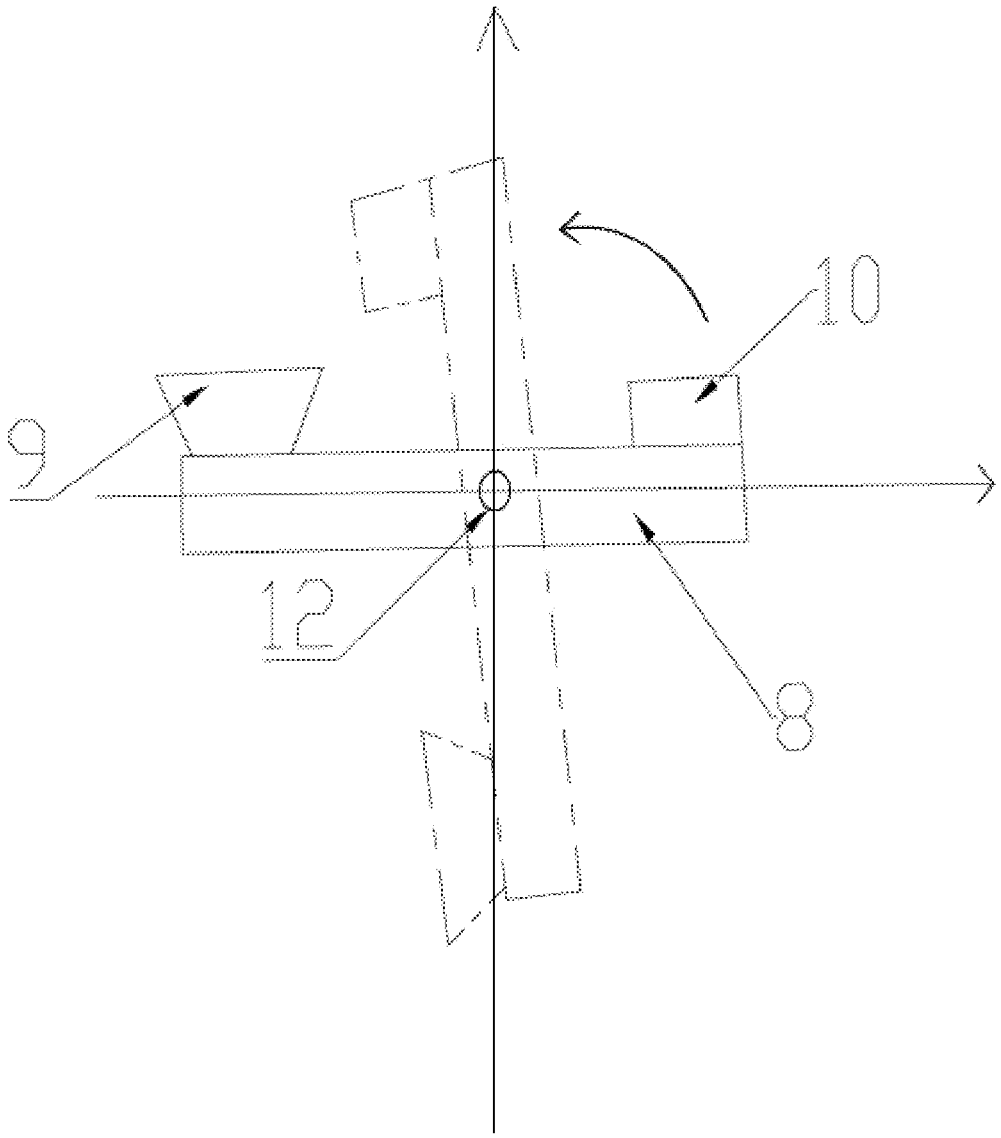
FIG. 9 is the schematic diagram of the tilt status of the valve body involved in the present invention.

The valve body 6 rotates with the shaft columns 12 as the pivot, and the drinking mode changes by adjusting the inclination angle of the container 1. The horizontal plane is taken as the reference coordinate. In the normal state, the container 1 is perpendicular to the horizontal plane. When the straw is used for drinking, the inclination angle of the container 1 is less than 90 degrees, and the block 10 on one side of the shaft columns 12 generates the downward gravity. Through the connecting plate 8, the plug 9 at the other side of the shaft columns 12 generates the upward force to block the first passage 4, so that the liquid in the container 1 cannot flow into the first passage 4. As shown in FIG. 9, when the user holds and tilts the container 1 for direct drinking, the valve body 6 rotates with the tilt of the container 1, using the shaft columns 12 as a pivot. The base coordinate of the shaft columns 12 remains unchanged. When the container 1 tilts to a certain extent, the plug 9 is detached from the first passage 4. Specifically, when the inclination angle of the container 1 is 90 degrees, the valve body 6 rotates 90 degrees, the block 10 rotates directly above the shaft columns 12, and the plug 9 rotates directly below the shaft columns 12. When the inclination angle of the container 1 is more than 90 degrees, the block 10 rotates from the right side to the left side of the shaft columns 12, the plug 9 rotates from the left side to the right side of the shaft columns 12, the barycenter of the block 10 moves above the plug 9, and the block 10 is pressed down by gravity, so that the plug 9 is detached from the first passage 4, and the user can drink the liquid in the container 1 through the first passage 4.

The upper end of the plug 9 is provided with the sealing fin 13. The outer contour of the upper end of the sealing fin 13 is more than that of the first passage 4, able to better fit the bottom of the first passage 4, so as to improve the sealing performance, and prevent the water in the container 1 from entering the first passage 4 when it is in the closed state.

The center of the connecting plate 8 is hollow; the straw 7 passes through the hollow area of the valve body 6 and is placed at the lower end of the second passage 5, and it can be disassembled.

The plug 9 is connected to the end of the connecting plate 8. The clamp block 14 is set at the lower end of the plug 9. The end of the connecting plate 8 is provided with the clamping slot 15 fitting the clamp block 14. The clamp block 14 is inserted into the clamping slot 15, which is convenient for assembly and disassembly at the time of cleaning. The stop rib 16 is set on the sidewall of the clamping slot 15. The limiting slot 17 fitting the stop rib 16 is set on the clamp block 14. The guide surface 18 is set on the stop rib 16, and is an inclined surface. During the assembly, the plug 9 is installed from top to bottom. The clamp block 14 can be more easily inserted into the clamping slot 15 by following the guide surface. The stop rib 16 is embedded into the limiting slot 17 to achieve clamping, improve connection strength, and prevent the plug 9 from falling off.

The lid 2 is composed of the upper lid 19 and the lower lid 20. The upper lid 19 is placed on the lower lid 20. The drinking spout 3 protrudes from the upper lid 19. The concave mounting slot 21 is set on the lower lid 20. The first passage 4 and the second passage 5 are located on the mounting slot 21. The sealing block 22 is set inside the mounting slot 21. The outer contour of the sealing block 22 fits the inner contour of the mounting slot 21. The sealing block 22 is made of soft rubber, closely assembled in the mounting slot 21, to enhance the sealing effect. The sealing block 22 is provided with the inlet slot 23 corresponding to the drinking spout 3. Inside the inlet slot 23, there is at least the inlet hole 24 for liquid inflow of the first passage 4 or the second passage 5. The inlet hole 24 has two embodiments: the first one is that the inlet hole 24 involves two holes that are respectively corresponding to the first passage 4 and the second passage 5; the second one is that the inlet hole is one hole covering the upper end of the first passage 4 and the second passage 5.

In the direct drinking mode, the liquid in the container 1 flows into the inlet slot 23 through the first passage 4 and the inlet hole 24, and then enters the drinking spout 3 from the inlet slot 23; in the straw mode, the liquid in the container 1 flows into the inlet slot 23 through the straw 7, the second passage 5, and the inlet hole 24, and then enters the drinking spout 3 from the inlet slot 23.

The sealing element 25 is installed between the upper lid 19 and the sealing block 22, composed of the seal ring 26 extending downward from the upper lid 19, and the sealing slot on the outer edge of the sealing block 22 that fits the seal ring 26. The seal ring 26 is set on the outer edge of the drinking spout 3. When the upper lid 19 is interlocked with the lower lid 20, the seal ring 26 is embedded in the sealing slot 27, to further improve the sealing performance.

The raised inlet valve 28 is set on the lower lid 20, located at the rear end of the drinking spout 3. The hole 29 is set on the corresponding position of the inlet valve 28 on the upper lid 19. The inlet valve 28 passes through the hole 29 and protrudes from the upper lid 19. At the time of continuous drinking, due to the decrease in air pressure inside the container 1, the generated negative pressure is inconvenient for users to drink water. The external air can enter through the inlet valve 28 to balance the internal and external air pressure, and ensure that the users can continue to drink. When the upper lid 19 and the lower lid 20 are assembled, the inlet valve 28 and the hole 29 can also play a role in positioning.

The top cap 30 is set above the lid 2 to close the drinking spout 3, and is rotatably connected above the lid 2. The rear end of the top cap 30 is axially connected to the lid 2, able to rotate and open with the shaft joint as the endpoint. The torsion spring is installed at the shaft joint to facilitate the opening of the cap.

Inside the top cap 30, there is the first sealing plug 31 fitting the drinking spout 3, and the second sealing plug 32 fitting the inlet valve 28. When the top cap 30 is closed, the first sealing plug 31 and the second sealing plug 32 respectively block the drinking spout 3 and the top of the inlet valve 28, so that the liquid in the container 1 cannot overflow.

Inside the lid 2, the locking block 33 is set and can slide to unlock; it is reset by the spring after sliding. The sliding block 34 and the locking piece 35 are set on the locking block 33. The sidewall of the lid 2 is provided with the sliding slot 36 fitting the sliding block 34 that protrudes from the sliding slot 36. The front end of the top cap 30 is equipped with the latch 37 that extends downward. The opening 38 fitting the latch 37 is set on the lid 2. When the top cap 30 is closed, the latch 37 passes through the opening 38 and is interlocked with the locking piece 35 to achieve fixation. At the time of unlocking, it is required to manually move the sliding block 34. The displacement of the locking block 33 to one side drives the displacement of the locking piece 35. The locking piece 35 is detached from the latch 37 to release the connection. The top cap 30 is opened by the resilience force of the torsion spring.

The seal ring 39 is installed between the container 1 and the lid 2, to improve the sealing performance between the lid 2 and the container 1, and prevent the liquid in the container 1 from overflowing from the gap of the threaded connection between the lid 2 and the container 1.

For the people skilled in the field, obviously, the present invention is not limited to the details of above exemplary embodiments, and it can be implemented in other specific forms without deviating from the spirit or essential characteristics of the present invention. From any point of view, the embodiments shall be considered to be exemplary and non-restrictive. The scope of the present invention is limited by the attached claims rather than the above description. Therefore, all the changes falling within the meaning and scope of the equivalents of the claims are included in the present invention, and the any marks of drawings in claims shall not be regarded as restricting the involved claims.

The invention claimed is:

1. A drinking container, comprising:

a container;

a lid covering the container; and a seal ring disposed between the container and the lid;

wherein a drinking spout is disposed on the lid, a first passage and a second passage are disposed on a lower end of the drinking spout, the first passage and the second passage are configured for liquid flow inside the container, a valve body is disposed in a lower end of the first passage, a lower end of the second passage is connected to a straw, the first passage is switched between an open state and a closed state, and the second passage is always in an open state;

wherein in a straw mode, a liquid in the container flows out of the drinking spout through the second passage, and the valve body inside the lid closes the first passage;

wherein in a direct drinking mode, the valve body opens the first passage, and the liquid in the container flows out of the drinking spout through the first passage;

wherein the valve body comprises a connecting plate, a plug disposed on a first end of the connecting plate, and a block disposed on a second end of the connecting plate, the first passage is closed through the plug, and the block is pushed to drive the valve body to move to expose the first passage.

2. The drinking container described in claim 1, wherein the valve body is movably connected to a lower end of the lid, shaft blocks are disposed in the lid, shaft columns are disposed on two sides of the connecting plate, the shaft blocks respectively fit two sides of the connecting plate, the valve body is fixed by installing the shaft columns respectively with the shaft blocks, and the valve body is only allowed to rotate toward the drinking spout.

3. The double drinking container described in claim 1, wherein a sealing fin is disposed on an upper end of the plug, and an outer contour of an upper end of the sealing fin is greater than an outer contour of an upper end of the first passage.

4. The double drinking container described in claim 1, wherein a center of the connecting plate is hollow, and the straw passes through the valve body and is placed at the lower end of the second passage.

5. The drinking container described in claim 1, wherein the lid comprises an upper lid and a lower lid, the upper lid is placed on the lower lid, the drinking spout protrudes from the upper lid, the lower lid is recessed to form a mounting slot, and the first passage and the second passage are formed on the mounting slot.

6. The drinking container described in claim 5, wherein a sealing block is disposed inside the mounting slot, an outer contour of the sealing block fits an inner contour of the mounting slot, an inlet slot corresponding to the drinking spout is defined on the sealing block, and at least one inlet hole for liquid inflow of the first passage or second passage are formed in the inlet slot;

wherein in the direct drinking mode, the liquid in the container flows into the inlet slot through the first passage and the at least one inlet hole, and then enters the drinking spout from the inlet slot;

wherein in the straw mode, the liquid in the container flows into the inlet slot through the straw, the second passage, and the at least one inlet hole, and then enters the drinking spout from the inlet slot.

7. The drinking container described in claim 1, wherein a inlet valve is disposed on the lid.

8. The drinking container described in claim 7, wherein a top cap configured to close the drinking spout is disposed on the lid, and the top cap is rotatably connected on the lid; a first sealing plug and a second sealing plug are disposed in the top cap, the first sealing plug is matched with the drinking spout, the second sealing plug is matched with the inlet valve, and the first sealing plug and the second sealing plug respectively block the drinking spout and the inlet valve when the top cap is closed.

9. The drinking container described in claim 1, wherein a locking block is disposed on a sidewall of the lid.

* * * * *